US007731541B1

(12) United States Patent
Lee et al.

(10) Patent No.: US 7,731,541 B1
(45) Date of Patent: Jun. 8, 2010

(54) BACKPLANE CONNECTOR WITH ONE-PIECE INSULATIVE BASES

(75) Inventors: Kuo-Ching Lee, Hsin-Tien (TW); Ta-Teh Meng, Hsin-Tien (TW); Jian-Li Guan, Hsin-Tien (TW); Fu-Zhi Gong, Hsin-Tien (TW)

(73) Assignee: Advanced Connectek Inc. (TW)

( * ) Notice: Subject to any disclaimer, the term of this patent is extended or adjusted under 35 U.S.C. 154(b) by 0 days.

(21) Appl. No.: 12/497,545

(22) Filed: Jul. 2, 2009

(30) Foreign Application Priority Data

May 18, 2009 (TW) ..... 98116371 A

(51) Int. Cl.
*H01R 24/00* (2006.01)

(52) U.S. Cl. ..... 439/660

(58) Field of Classification Search ..... 439/660, 439/736, 74, 444
See application file for complete search history.

(56) References Cited

U.S. PATENT DOCUMENTS 5,906,518 A * 5/1999 Sun ..... 439/660
7,229,319 B2 6/2007 Dahms

* cited by examiner

*Primary Examiner*—Javaid Nasri
(74) *Attorney, Agent, or Firm*—Hershkovitz & Associates, LLC; Abraham Hershkovitz

(57) ABSTRACT

A backplane connector has a housing, a first insulative base, a second insulative base, multiple first terminals, multiple second terminals and multiple third terminals. Each of the insulative bases is mounted in the housing and is formed into one-piece. The first terminals are mounted on the first insulative base. The second terminals are mounted on the second insulative base. The third terminals are mounted on the insulative bases. The one-piece insulative bases excellently reduce their tolerances and raise the structurally strength of the backplane connector. Therefore, the production rate of the backplane connector increases.

19 Claims, 9 Drawing Sheets

BACKPLANE CONNECTOR WITH ONE-PIECE INSULATIVE BASES

BACKGROUND OF THE INVENTION

1. Field of the Invention

The present invention relates to a connector, and more particularly to a backplane connector that has a desirable low tolerance and is structurally strong and durable for repetitious engagements with and disengagements from corresponding computer accessory cards such as graphic cards, redundant array of independent disks (RAID) cards or memory modules.

2. Description of Related Art

Servers such as blade servers and rack mount servers have a printed circuit board (PCB) mounted with backplane connectors for high speed and stable signal transmission thus to avoid using cable connectors that have deformation, disorder and durable problems.

U.S. Pat. No. 7,229,319 discloses a backplane connector on a PCB and having a housing and multiple disk shaped contact modules. The housing has an insertion slot and multiple spaces. The insertion slot may receive an accessory card. The contact modules are mounted respectively in the spaces and are arranged abreast in a row. Each contact module has an insulating member and a pair of electrical contacts. The electrical contacts may be a differential signaling pair, is mounted on the insulating member by inserting molding processes and provides electrical connection.

However, the backplane connector with the abreast-abutted contact modules has following disadvantages.

1. Each contact module has its individual tolerance. When all the contact modules are arranged abreast together, a total tolerance thereof always exceeds the reasonable expectation, which causes fabrication failure of the backplane connector and the deformation, loose and disassembly of the contact modules. Therefore, the durability and production rate of the backplane connector are decreased.

2. The abreast abutted contact modules do not have firmly fastening elements to fasten each other so that a whole structure thereof is weak and not durable. After suffering repeatedly engagement with and disengagement from corresponding accessory cards, the contact modules easily loosen, fall off and break and thus lower the stability of the signal transmission, cause the server to crash and even result in huge business loss.

3. The housing is hollow and implemented without any crossbeam structures so is structurally weak and cannot protect the contact modules therein, which further makes the signal transmission of the backplane connector unstable.

To overcome the shortcomings, the present invention provides a backplane connector with one-piece insulative bases to mitigate or obviate the aforementioned problems.

SUMMARY OF THE INVENTION

The main objective of the invention is to provide a backplane connector that has a desirable low tolerance and is structurally strong and durable for repetitious engagements with and disengagements from corresponding computer accessory cards.

A backplane connector in accordance with the present invention has a housing, a first insulative base, a second insulative base, multiple first terminals, multiple second terminals and multiple third terminals. Each of the insulative bases is mounted in the housing and is formed into one-piece.

The first terminals are mounted on the first insulative base. The second terminals are mounted on the second insulative base. The third terminals are mounted on the insulative bases. The one-piece insulative bases excellently reduce their tolerances and raise the structurally strength of the backplane connector. Therefore, the production rate of the backplane connector increases.

Other objectives, advantages and novel features of the invention will become more apparent from the following detailed description when taken in conjunction with the accompanying drawings.

BRIEF DESCRIPTION OF THE DRAWINGS

FIG. 9 is another cross sectional end view of the backplane connector in

FIG. 1.

DETAILED DESCRIPTION OF THE PREFERRED EMBODIMENT

Figure 1:
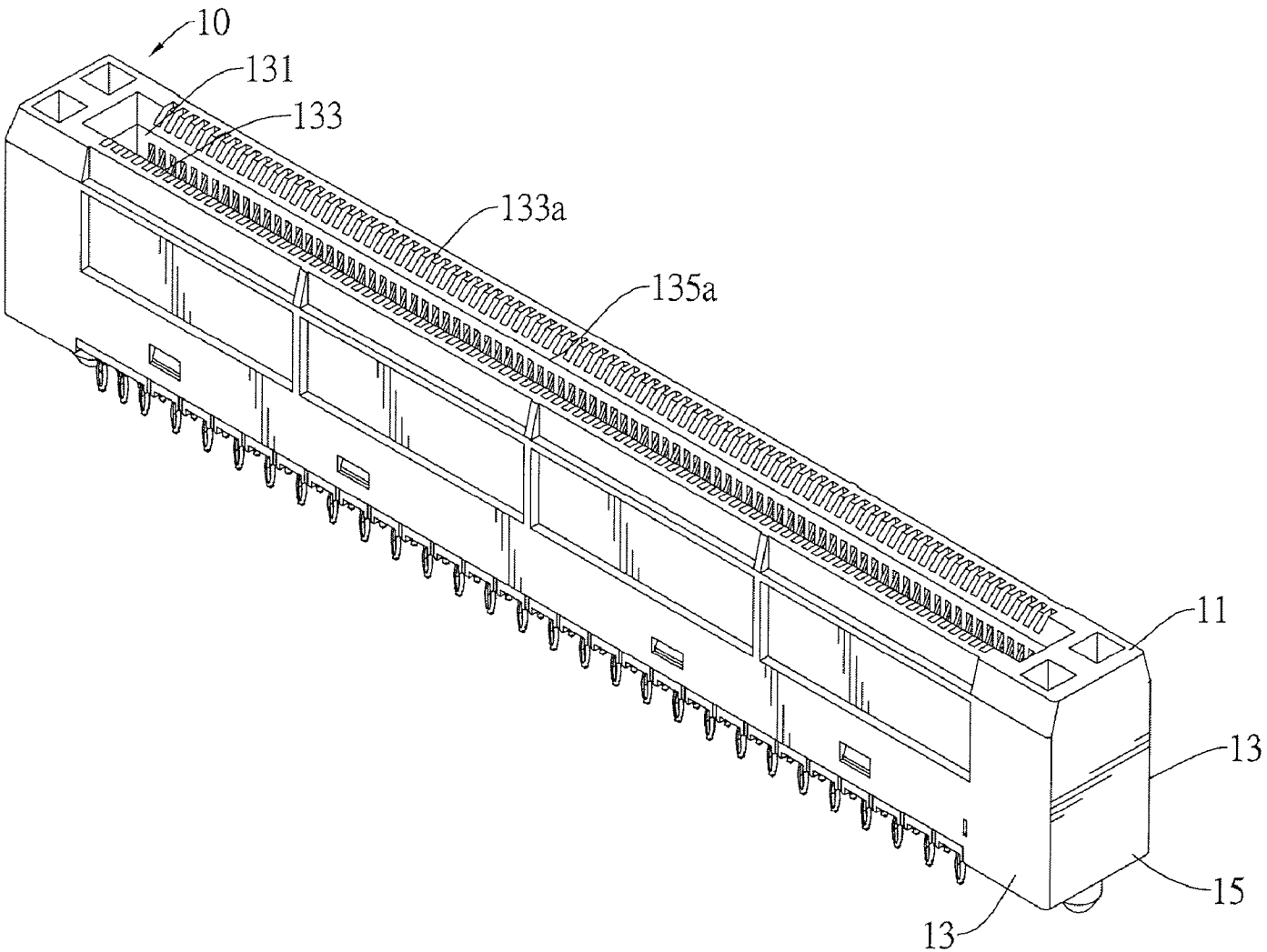
FIG. 1 is a top perspective view of a backplane connector with one-piece insulative bases in accordance with the present invention.
Figure 2:
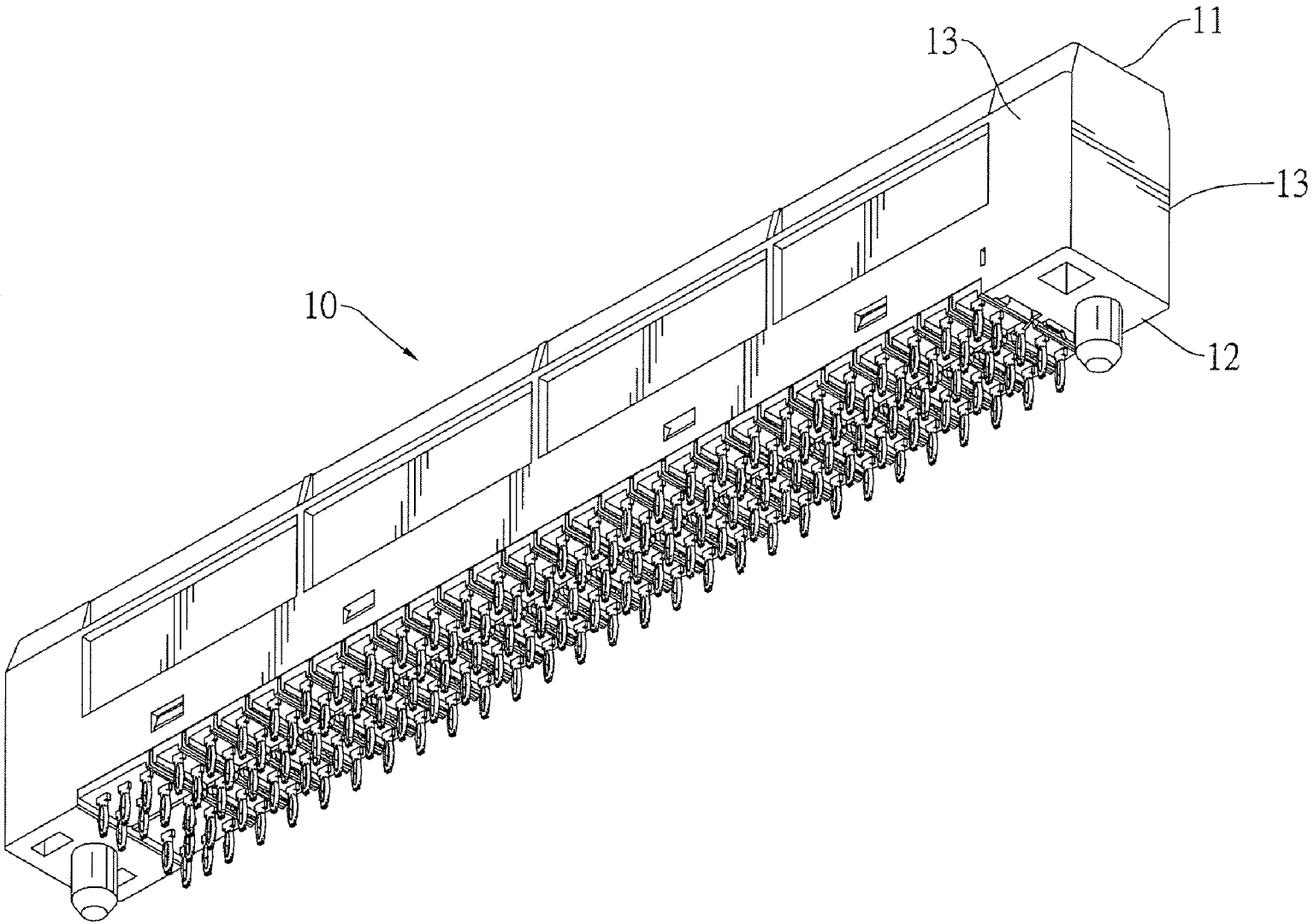
FIG. 2 is a bottom perspective view of the backplane connector in FIG. 1.
Figure 3:
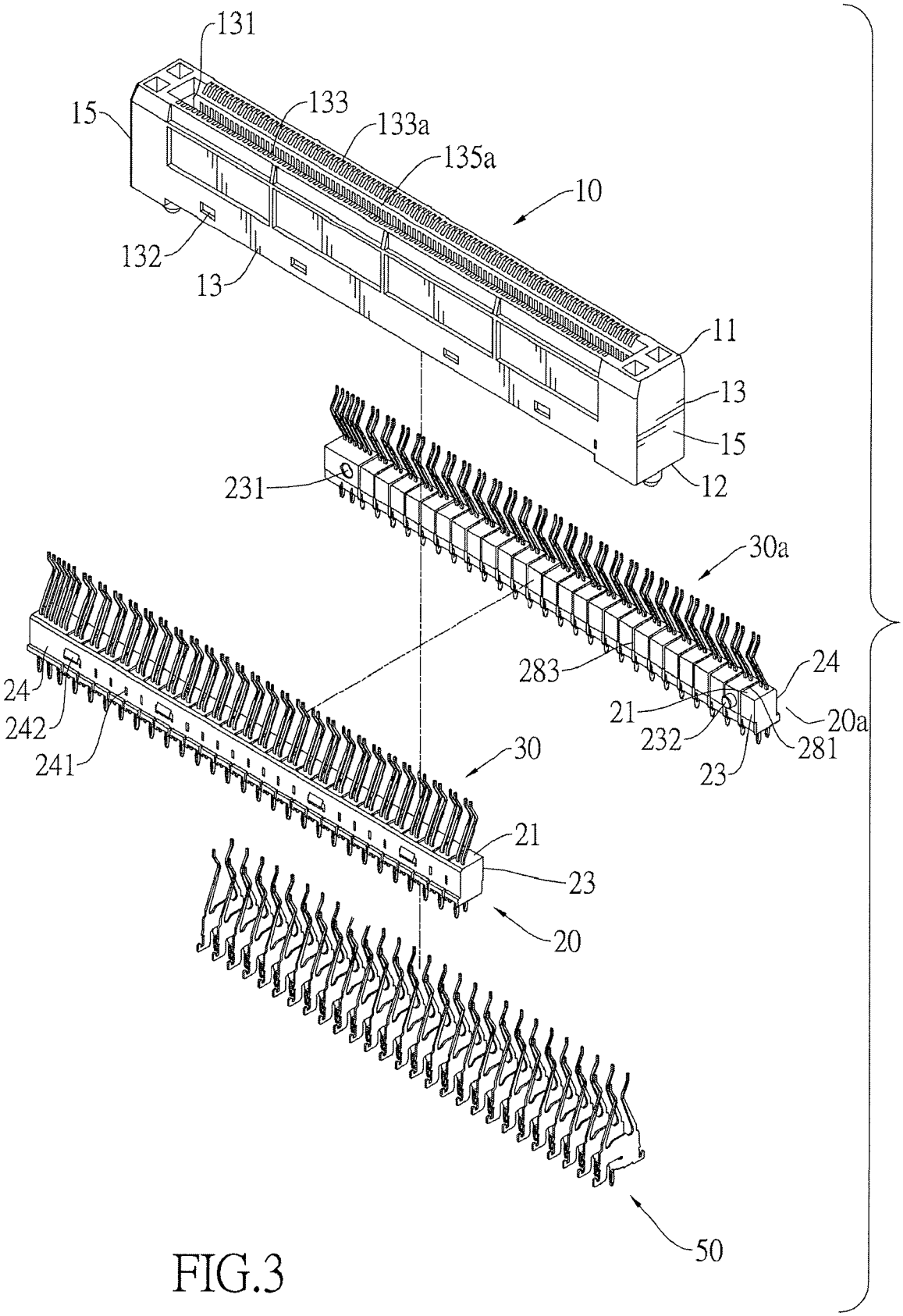
FIG. 3 is an exploded top perspective view of the backplane connector in FIG. 1.
Figure 4:
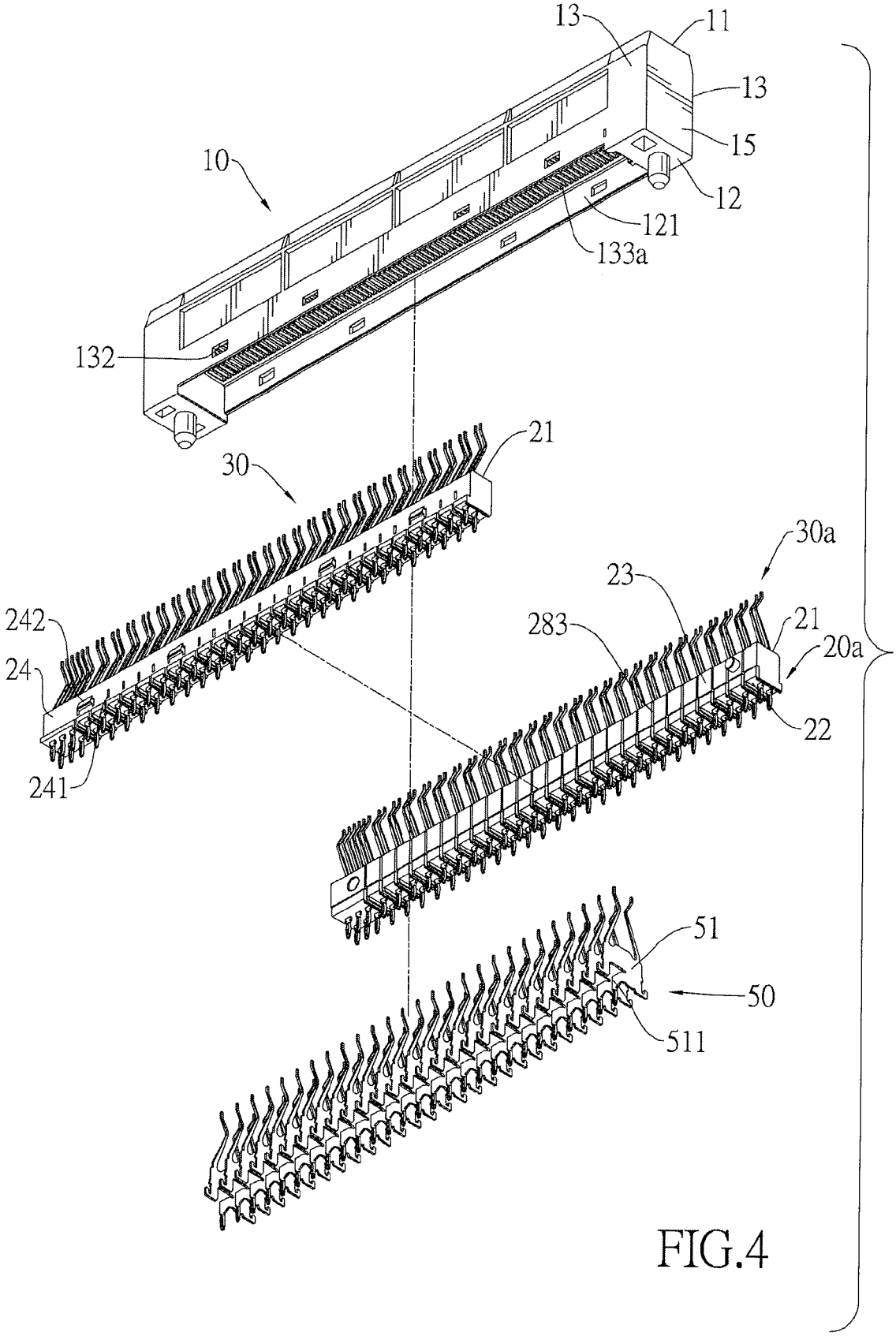
FIG. 4 is an exploded bottom perspective view of the backplane connector in FIG. 2.

With reference to FIGS. 1 to 4, a backplane connector in accordance with the present invention may be mounted on a PCB such as a mother board and may be detachably connected to corresponding accessory cards. The backplane connector comprises a housing (10), a first insulative base (20), a second insulative base (20*a*), multiple first terminals (30), multiple second terminals (30*a*) and multiple third terminals (50).

Figure 5:
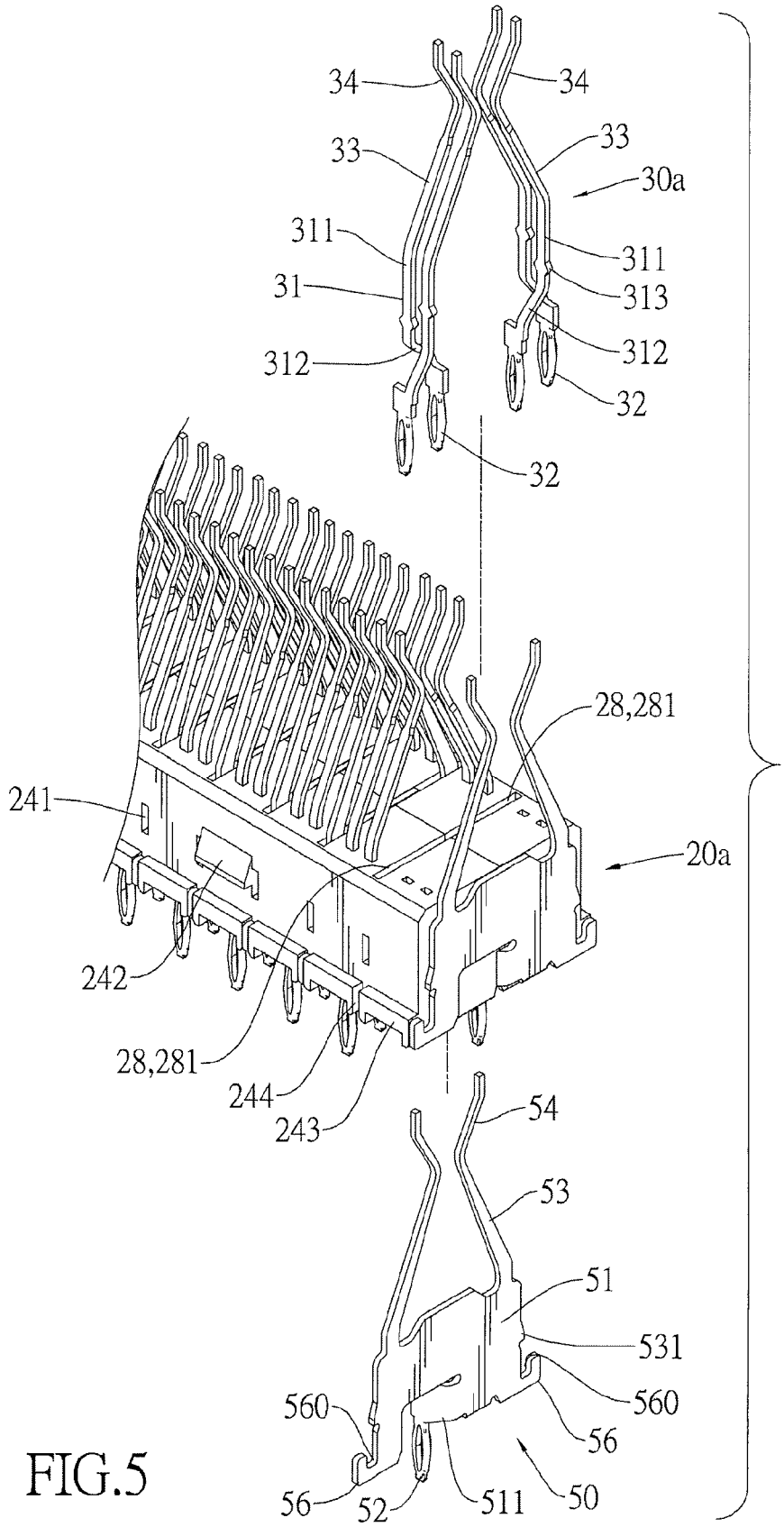
FIG. 5 is an enlarged and exploded top perspective of the first and second insulative bases and the first, second and third terminals of the backplane connector in FIG. 1.
Figure 6:
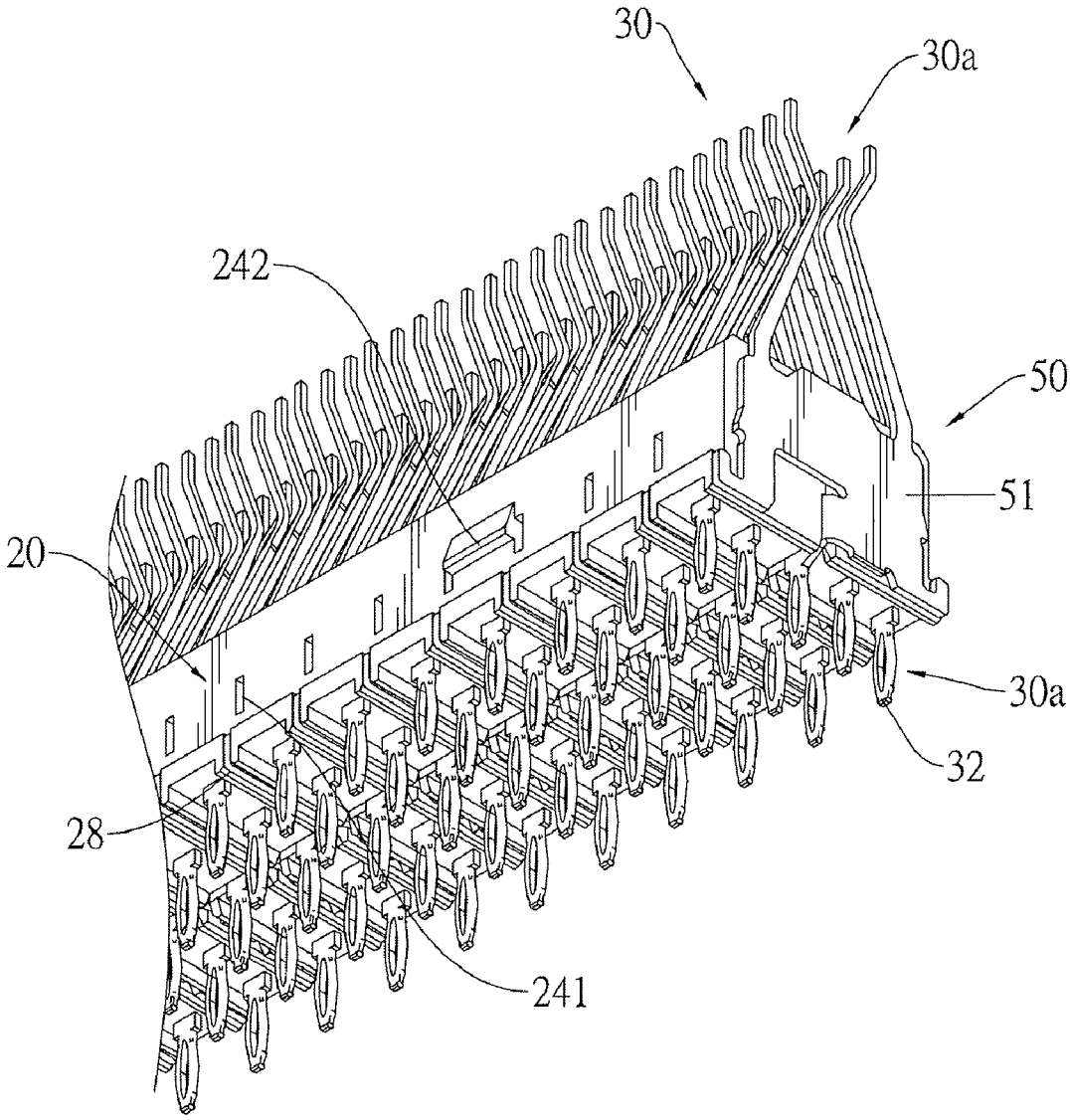
FIG. 6 is an enlarged bottom perspective view of the first and second insulating bases and the first, second and third terminals of the backplane connector in FIG. 2.
Figure 7:
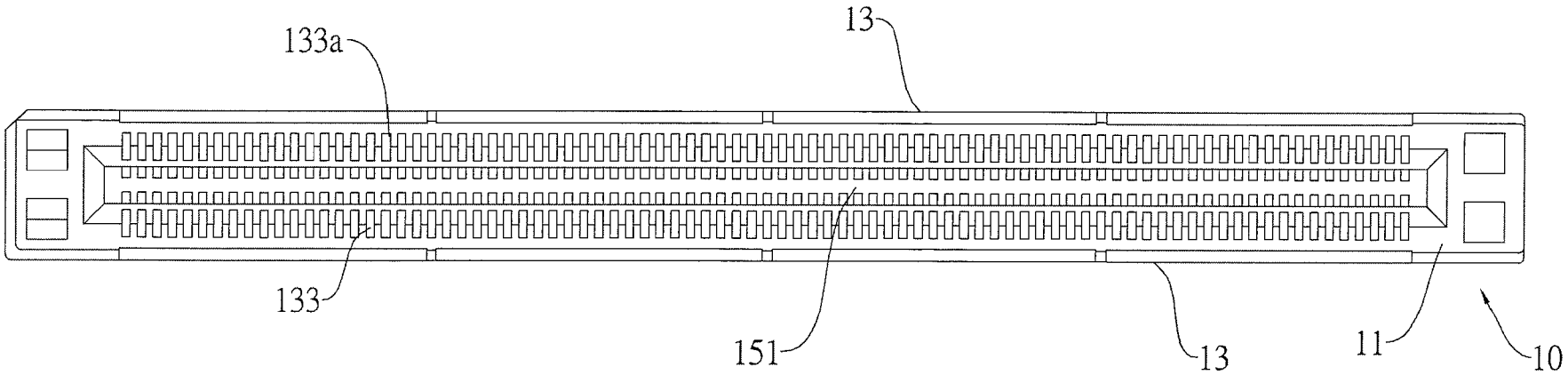
FIG. 7 is a top view of the housing of the backplane connector in FIG. 2.
Figure 8:
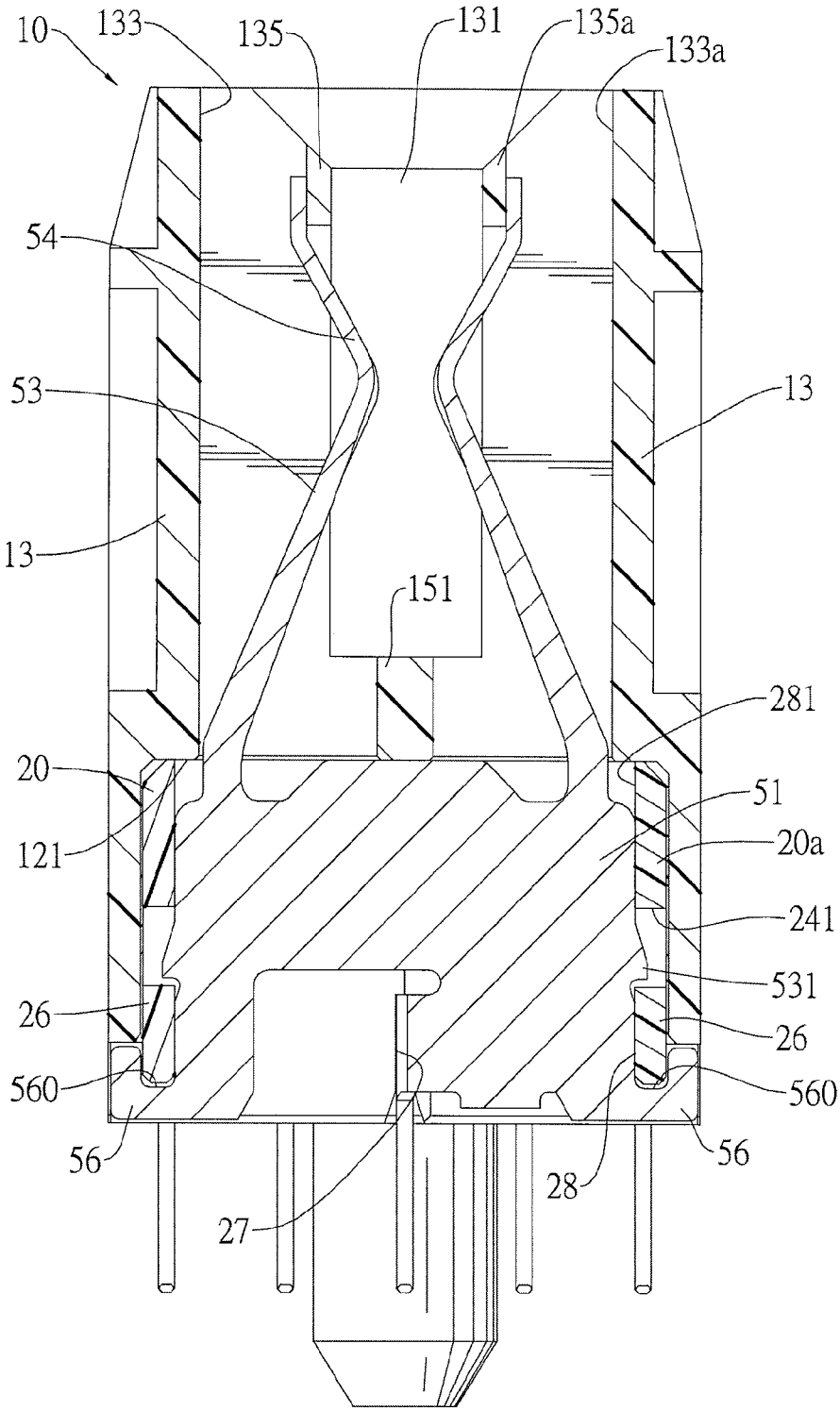
FIG. 8 is a cross sectional end view of the backplane connector in FIG. 1.
Figure 9:
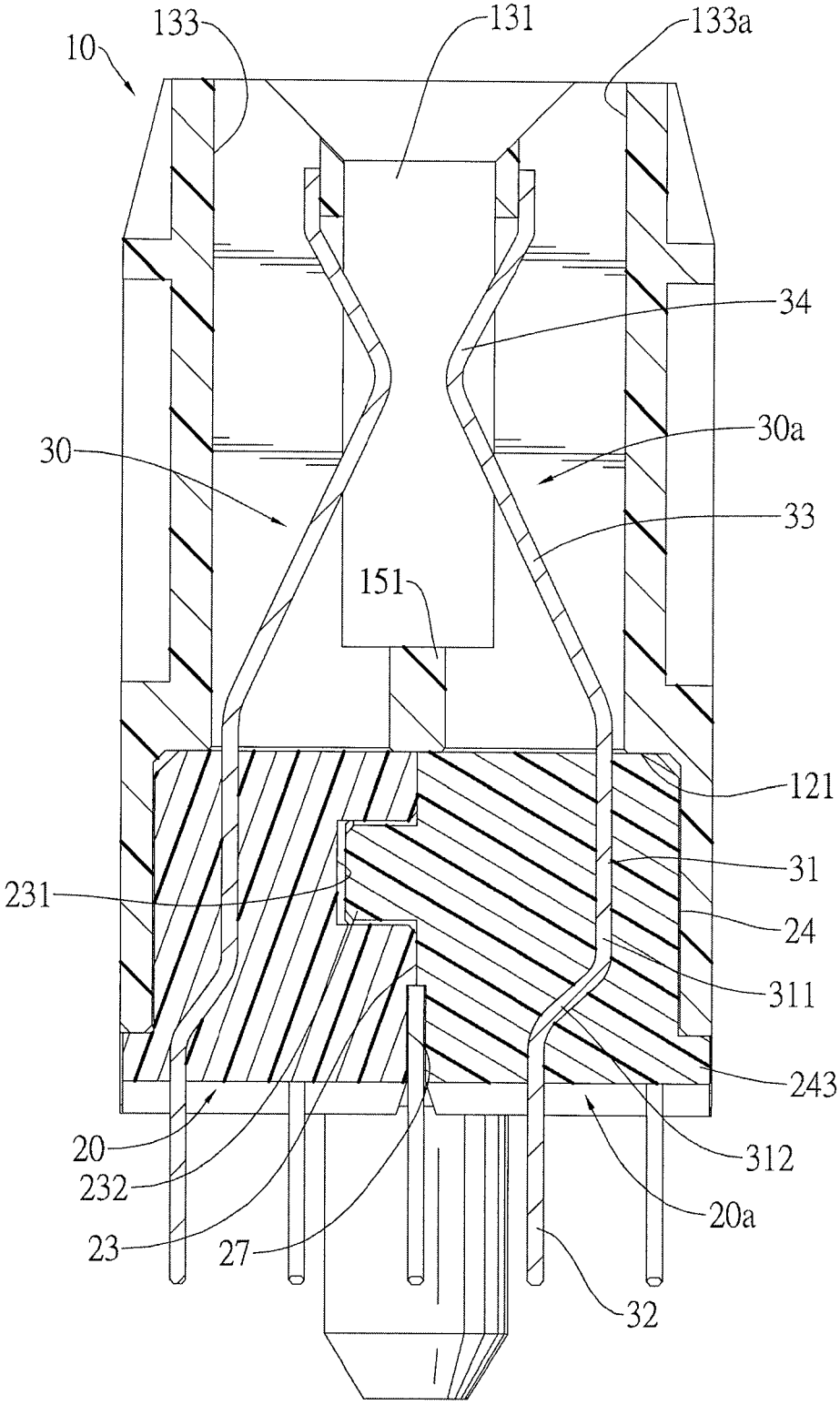

With further reference to FIGS. 5 to 8, the housing (10) may be insulative and has a top (11), a bottom (12), two opposite sidewalls (13), two opposite ends (15), an insertion slot (131) and a mounting slot (121) and may further have multiple first positioning slots (133), multiple second positioning slots (133*a*), a supporting spine (151) and two sets of multiple fastening holes (132).

The insertion slot (131) is defined in the housing (10) adjacent to the top (11) to accommodate and hold corresponding accessory cards.

The mounting slot (121) is defined in the housing (10) adjacent to the bottom (12) and is opposite to and communicates with the insertion slot (131).

The first positioning slots (133) are defined in the top (11) adjacent to one sidewall (13).

The second positioning slots (133*a*) are defined in the top (11) adjacent to the other sidewall (13).

The supporting spine (151) is longitudinal, is formed between the insertion slot (13) and the mounting slot (121) and is connected to the ends (15).

The sets of the fastening holes (132) are transversely defined respectively in the sidewalls (13).

The first insulative base (20) is longitudinal, is formed into one piece and is mounted in the mounting slot (12) of the housing (10). The first insulative base (20) has a top surface (21), a bottom surface (22), an inside surface (23), an outside surface (24), two ends and multiple inserting slits (28) and may further have a hooking portion (26), multiple connecting elements, multiple fastening protrusions (242) and hooking holes (241).

The inserting slits (28) are defined in the first insulative base (20) and each inserting slit (28) may have a top opening (281) adjacent to the top surface (21) and an inside opening (283) adjacent to the inside surface (23).

The hooking portion (26) is formed on the outside surface (24) adjacent to the bottom surface (22).

The connecting elements are formed on the inside surface (23) and may be at least one assembling hole (231) and at least one assembling protrusion (232).

The fastening protrusions (242) are formed on the outside surface (24) and are mounted respectively through the fastening holes (132) of one set of the housing (10).

The hooking holes (241) are defined in the outside surface (24).

The second insulative base (20*a*) is longitudinal, is formed into one piece, is mounted in the mounting slot (12) of the housing (10) and is arranged symmetrically with the first insulative housing (20). The first insulative base (20) has a top surface (21), a bottom surface (22), an inside surface (23), an outside surface (24), two ends and multiple inserting slits (28) and may further have a hooking portion (26), multiple connecting elements, multiple fastening protrusions (242) and hooking holes (241).

The inserting slits (28) are defined in the second insulative base (20*a*) and each inserting slit (28) may have a top opening (281) adjacent to the top surface (21) and an inside opening (283) adjacent to the inside surface (23).

The hooking portion (26) is formed on the outside surface (24) of the second insulative base (20*a*) adjacent to the bottom surface (22).

The connecting elements are formed on the inside surface (23) of the second insulative base (20*a*), are connected respectively to the connecting elements of the first insulative base (20) to securely hold the first and second insulative bases (20, 20*a*) together. The connecting elements of the second insulative base (20*a*) may be at least one assembling hole (231) mounted respectively around the at least one assembling protrusion (232) of the first insulative base (20) and at least one assembling protrusion (232) mounted respectively in the at least one assembling hole (231) of the first insulative base (20).

The fastening protrusions (242) are formed on the outside surface (24) of the second insulative base (20*a*) and are mounted respectively through the fastening holes (132) of the other set of the housing (10).

The hooking holes (241) are defined in the outside surface (24) of the second insulative base (20*a*).

The first terminals (30) may be signal transmission terminals, may be multiple pairs of first differential signal transmission terminals and are mounted securely on the first insulative base (20) by an inserting molding process.

The second terminals (30*a*) may be signal transmission terminals, may be multiple pairs of second differential signal transmission terminals aligned respectively with the pairs of the first differential signal transmission terminals and are mounted securely on the second insulative base (20*a*) by an inserting molding process.

Each of the first and second terminals (30, 30*a*) may have a mounting section (31), a soldering section (32), a resilient arm (33) and a contacting section (34).

The mounting section (31) is mounted in the first or second insulative base (20, 20*a*) and may be non-linear to have a first portion (311), a second portion (312) and at least one tooth (313). The second portion (312) is bent relative to the first portion (311) to securely hold the mounting section (31) in the first or second insulative base (20, 20*a*) without inadvertently moving. The at least one tooth (313) is formed on the mounting section (31) and bites the first or second insulative base (20, 20*a*) to reinforce the engagement of the mounting section and the first or second insulative base (20, 20*a*).

The soldering section (32) is formed on and protrudes downwards from the mounting section (31), extends out of the mounting slot (121) of the housing (10) and may be soldered on the PCB.

The resilient arm (33) is formed on and protrudes upwards from the mounting section (31) and may be located in one of the first and second positioning slots (133, 133*a*) of the housing (10).

The contacting section (34) is formed on and protrudes from the resilient arm (33) to electrically contact an electrical contact of an accessory card.

The third terminals (50) may be grounding terminals, are mounted respectively in the inserting slots (28) of the first insulative base (20) and are mounted respectively in the inserting slots (28) of the second insulative base (20*a*). In a preferred embodiment, the grounding terminals are arranged alternately with the pairs of the first differential signal transmission terminals and are arranged alternately with the pairs of the second differential signal transmission terminals.

Each third terminal (50) may have a mounting segment (51), a soldering segment (52), two flexible arms (53) and two contacting segments (54).

The mounting segment (51) is mounted in one inserting slit (28) of the first insulative base (20) and one inserting slit (28) of the second insulative base (20*a*) and may extend through the inside openings (283) of the inserting slits (28) of the first and second insulative bases (20, 20*a*). The mounting segment (51) has two opposite sides, two hooking members (531) and two hooks (56). The hooking members (531) are formed respectively on the sides and respectively hook on one hooking hole (241) of the first insulative base (20) and one hooking hole (241) of the second insulative base (20*a*). Each hooking member (531) may be a right triangle and have an inclined guiding edge facilitating the engagement with the hooking hole (241) and a lateral linear edge preventing inadvertent disengagement thereof. The hooks (56) are L-shaped, are formed respectively on the sides and respectively hook on the hooking portions (26) of the first and second insulative bases (20, 20*a*). Each hook (56) has a hooking notch (560) engaged with one hooking portion (26).

The soldering segment (52) is formed on and protrudes downwards from the mounting segment (51) and extends out of the mounting slot (121) of the housing (10).

The flexible arms (53) are formed on and protrude from the mounting segment (51). Each flexible arm (53) extends through the top opening (281) of one inserting slit (28) of the first and second insulative bases (20, 20*a*) and is located in one of the first and second positioning slots (133, 133*a*) of the housing (10).

The contacting segments (54) are formed respectively on and protrude from the flexible arms (53).

In a preferred embodiment, the first insulative base (20) further has a first pressing strip (135) formed on the first insulative base (20), extending through the first positioning slots (133) and pressing against the contacting section (34) of each first terminal (30) and one contacting segment (54) of each third terminal (50). The second insulative base (20*a*) further has a second pressing strip (135*a*) formed on the second insulative base (20*a*), extending through the second positioning slots (133*a*) and pressing against the contacting section (34) of each second terminal (30*a*) and the other contacting segment (54) of each third terminal (50). The first and second pressing strips (135, 135*a*) slightly press against and make the contacting sections (34) and segments (54) tight to provide sufficient resilient force to the electrical contacts of the accessory cards.

Furthermore, in a preferred embodiment, a positioning slit (27) is defined between the first and second insulative bases (20, 20*a*). Each mounting segment (51) of the third terminal (50) further has a positioning tab (511) formed on and protruding longitudinally and perpendicularly from the mounting segment (51) and mounted in the positioning slit (27). The soldering segment (51) of each third terminal (50) is formed on and protrudes downwards from the positioning tab (511).

Moreover, in a preferred embodiment, each of the first and second insulative bases (20, 20*a*) further has a positioning rib (243). The positioning rib (243) is formed and protrudes transversely outwards from the outside surface (24) of the each of the first and second insulative bases (20, 20*a*) and has multiple notches (244) defined in the positioning rib (243). Each notch (244) accommodates one hook (56) of each third terminal (50) to prevent the hook (56) from extending out of the first or second insulative base (20) and inadvertently contacting nearby electronic components to cause short circuit.

The present invention has following advantages.

1. The first and second terminals (30, 30*a*) are mounted securely on the longitudinal first and second insulative bases (20, 20*a*) by the insert molding process so that a total tolerance is the single tolerance of the first or second insulative base (20, 20*a*). Unlike the out-of-control accumulated tolerances of disk-shaped contact modules of a conventional backplane connector, the single tolerance is predictable and precisely controlled to prevent fabrication failure and inadvertent disassembly of the backplane connector and thus improves the signal transmission stability of the backplane connector. Therefore, the production rate of the backplane connector increases.

2. The first and second insulative bases (20, 20*a*) are one-piece instead of consisting of separate parts so that the rigidity and strength thereof are greater than those of a combination of the conventional abreast-arranged contact modules. Therefore, the durability of plug and unplug of the backplane connector increases.

3. The supporting spine (151) raises the structurally strength of the housing (10) and prevents the first and second insulative bases (20, 20*a*) and first, second and third terminals (30, 30*a*, 50) from deforming to further improve the signal transmission stability.

4. The hooks (56) of the mounting segment (51) of the third terminals (50) hook on the hooking portions (26) of the first and second insulative bases (20, 20*a*) to improve the combination of the first and second insulative bases (20, 20*a*) and prevent inadvertent disengagement.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A backplane connector comprising:

a housing having an insertion slot defined in the housing; and a mounting slot defined in the housing opposite to the insertion slot;

a first insulative base, being longitudinal, formed into one-piece, mounted in the mounting slot of the housing and having multiple inserting slits defined in the first insulative base;

a second insulative base, being longitudinal, formed into one-piece, mounted in the mounting slot of the housing and having multiple inserting slits defined in the second insulative base;

multiple first terminals mounted on the first insulative base;

multiple second terminals mounted on the second insulative base; and multiple third terminals mounted respectively in the inserting slits of the first insulative base and mounted respectively in the inserting slits of the second insulative base; wherein each of the first and second insulative bases further has a top surface, a bottom surface, an inside surface, an outside surface and two ends and further has a hooking portion formed on the outside surface adjacent to the bottom surface of each of the first and second insulative bases;

the inserting slits of each of the first and second insulative bases are defined in the bottom surface of each of the first and second insulative bases; and each third terminal has two hooks formed on the third terminal and respectively hooking on the hooking portions and each hook has a hooking notch engaged with one of the hooking portions.

2. The backplane connector as claimed in claim 1, wherein the housing further has a top, a bottom, two opposite sidewalls, two opposite ends;

the insertion slot is adjacent to the top; and the mounting slot is adjacent to the bottom and communicates with the insertion slot.

3. The backplane connector as claimed in claim 2, wherein the housing further has multiple first positioning slots defined in the top adjacent to one sidewall; and multiple second positioning slots defined in the top adjacent to the other sidewall.

4. The backplane connector as claimed in claim 3, wherein the housing further has a supporting spine being longitudinal, formed between the insertion slot and the mounting slot and connected to the ends.

5. The backplane connector as claimed in claim 4, wherein each of the first and second terminals has a mounting section mounted in the first or second insulative base;

a soldering section formed on and protruding downwards from the mounting section and extending out of the mounting slot of the housing;

a resilient arm formed on and protruding upwards from the mounting section and located in one of the first and second positioning slots of the housing; and a contacting section formed on and protruding from the resilient arm.

6. The backplane connector as claimed in claim 5, wherein each third terminal further has a mounting segment mounted in one inserting slit of the first insulative base and one inserting slit of the second insulative base and having two opposite sides;

a soldering segment formed on and protruding downwards from the mounting segment and extending out of the mounting slot of the housing;

two flexible arms formed on and protruding from the mounting segment and each flexible arm located in one of the first and second positioning slots of the housing; and two contacting segments formed respectively on and protruding from the flexible arms; and the hooks of each third terminal are formed respectively on the sides of the mounting segment.

7. The backplane connector as claimed in claim 6, wherein each inserting slit of each of the first and second insulative bases has a top opening adjacent to the top surface and an inside opening adjacent to the inside surface of each of the first and second insulative bases;

each mounting segment of each third terminal extends through the inside opening of one inserting slit of the first insulative base and through the inside opening of one inserting slit of the second insulative base; and each flexible arm of each third terminal extends through the top opening of one inserting slit of the first and second insulative bases.

8. The backplane connector as claimed in claim 7, wherein the first insulative base further has a first pressing strip formed on the first insulative base, extending through the first positioning slots and pressing against the contacting section of each first terminal and one contacting segment of each third terminal; and the second insulative base further has a second pressing strip formed on the second insulative base, extending through the second positioning slots and pressing against the contacting section of each second terminal and the other contacting segment of each third terminal.

9. The backplane connector as claimed in claim 8, wherein a positioning slit is defined between the first and second insulative bases;

each mounting segment of the third terminal further has a positioning tab formed on and protruding longitudinally and perpendicularly from the mounting segment and mounted in the positioning slit; and the soldering segment of each third terminal is formed on and protrudes downwards from the positioning tab.

10. The backplane connector as claimed in claim 9, wherein each of the first and second insulative bases further has a positioning rib formed and protruding transversely outwards from the outside surface of the each of the first and second insulative bases and having multiple notches defined in the positioning rib, and each notch accommodates one hook of each third terminal.

11. The backplane connector as claimed in claim 9, wherein the housing are insulative.

12. The backplane connector as claimed in claim 9, wherein the first insulative base further has multiple connecting elements formed on the inside surface; and the second insulative base further has multiple connecting elements formed on the inside surface of the second insulative base and connected respectively to the connecting elements of the first insulative base.

13. The backplane connector as claimed in claim 9, wherein the housing further has two sets of multiple fastening holes transversely defined respectively in the sidewalls;

the first insulative base further has multiple fastening protrusions formed on the outside surface and mounted respectively through the fastening holes of one set of the housing; and the second insulative base further has multiple fastening protrusions formed on the outside surface of the second insulative base and mounted respectively through the fastening holes of the other set of the housing.

14. The backplane connector as claimed in claim 9, wherein each of the first and second insulative bases further has multiple hooking holes defined in the outside surface of each of the first and second insulative bases; and each third terminal further has two hooking members formed respectively on the sides and respectively hooking on one hooking hole of the first insulative base and one hooking hole of the second insulative base.

15. The backplane connector as claimed in claim 9, wherein the first and second terminals are signal transmission terminals.

16. The backplane connector as claimed in claim 9, wherein the third terminals are grounding terminals.

17. The backplane connector as claimed in claim 16, wherein the first terminals are multiple pairs of first differential signal transmission terminals; and the second terminals are multiple pairs of second differential signal transmission terminals aligned respectively with the pairs of the first differential signal transmission terminals.

18. The backplane connector as claimed in claim 17, wherein the grounding terminals are arranged alternately with the pairs of the first differential signal transmission terminals and are arranged alternately with the pairs of the second differential signal transmission terminals.

19. The backplane connector as claimed in claim 9, wherein the first terminals are mounted on the first insulative base by an inserting molding process; and the second terminals are mounted on the second insulative base by an inserting molding process.

* * * * *